US006387542B1

(12) United States Patent
Kozlov et al.

(10) Patent No.: US 6,387,542 B1
(45) Date of Patent: May 14, 2002

(54) ELECTROLESS SILVER PLATING

(75) Inventors: Alexander S. Kozlov, Wharton; Thirumalai Palanisamy, Morristown; Dave Narasimhan, Flemington, all of NJ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/611,185

(22) Filed: Jul. 6, 2000

(51) Int. Cl.[7] ..... B05D 1/18; B05D 5/12; C09D 5/00

(52) U.S. Cl. ..... 428/673; 427/125; 427/98; 427/437; 427/443.1; 106/1.23

(58) Field of Search ..... 427/125, 437, 427/443.1, 98; 106/1.23; 428/673

(56) References Cited

U.S. PATENT DOCUMENTS 3,960,564 A * 6/1976 Molenaar et al. ..... 96/48 PD
3,995,371 A * 12/1976 O'Keefe ..... 32/15
4,144,361 A * 3/1979 Feldstein ..... 427/162
4,652,465 A * 3/1987 Koto et al. ..... 427/216
5,395,651 A * 3/1995 Sodervall et al. ..... 427/304
5,795,828 A * 8/1998 Endo et al. ..... 438/678

* cited by examiner

*Primary Examiner*—Michael Barr
(74) *Attorney, Agent, or Firm*—Kris T. Fredrick

(57) ABSTRACT

This invention relates to electroless plating of silver onto a substrate, an aqueous silver plating bath, a process for plating a uniform coating of silver onto various substrates using an electroless plating composition, and a silver plated article formed therefrom. The plating bath neither contains nor generates toxic or flammable substances or substances that may contaminate the silver coating. By avoiding strong complexing agents, virtually pure silver may be precipitated from the bath by simple boiling. Silver electroless autocatalytic plating bath consists of silver nitrate, ammonium hydroxide and hydrazine hydrate.

28 Claims, No Drawings

ELECTROLESS SILVER PLATING

BACKGROUND OF THE INVENTION

1. Field of the Invention

The present invention relates to electroless plating of silver onto a substrate. More particularly, this invention pertains to an aqueous silver plating bath, a process for plating a uniform coating of silver onto various substrates using an electroless plating composition, and a silver plated article formed therefrom.

2. Description of the Related Art

Plating of metals is a well known process employed to alter the existing surface properties or dimensions of a substrate. For example, a substrate may be plated for decorative purposes, to improve resistance to corrosion or abrasion, or to impart desirable electrical or magnetic properties to a substrate. Plating is a common practice many industries, including the manufacture of a variety of electronic packaging substrates, such as printed circuit boards.

There are various methods of plating known in the art, including electroplating and electroless plating. Electroplating involves the formation of an electrolytic cell wherein a plating metal represents an anode and a substrate represents a cathode, and an external electrical charge is supplied to the cell to facilitate the coating the substrate.

Electroless plating involves the deposition of a metallic coating from an aqueous bath onto a substrate by a controlled chemical reduction reaction which is catalyzed by the metal or alloy being deposited or reduced. This process differs from electroplating in that it requires no external electrical charge. One attractive benefit of electroless plating over electroplating is the ability to plate a substantially uniform metallic coating onto a substrate having an irregular shape. Frequently, electroplating an irregularly shaped substrate produces a coating having non-uniform deposit thicknesses because of varying distances between the cathode and anode of the electrolytic cell. Electroless plating obviates this problem by excluding the electrolytic cell. Another benefit of electroless plating over electroplating is that electroless plating is autocatalytic and continuous once the process is initiated, requiring only occasional replenishment of the aqueous bath. Electroplating requires an electrically conductive cathode and continues only while an electric current is supplied to the cell. Also, electroless coatings are virtually nonporous, which allows for greater corrosion resistance than electroplated substrates.

In general, an electroless plating bath includes water, a water soluble compound containing the metal to be deposited onto a substrate, a complexing agent that prevents chemical reduction of the metal ions in solution while permitting selective chemical reduction on a surface of the substrate, and a chemical reducing agent for the metal ions. Additionally, the plating bath may include a buffer for controlling pH and various optional additives, such as bath stabilizers and surfactants. The composition of a plating bath typically varies based on the particular goals of the plating process. For example, U.S. Pat. No. 6,042,889, teaches an electroless plating bath having a hypophosphite reducing agent and employing one of several different "mediator ions", including silver ions, for the purpose of converting a non-autocatalytic metal-reduction reaction into an autocatalytic reaction to plate a substrate with copper.

Silver is a desirable plating metal for its high electrical conductivity, corrosion resistance and good friction and wear properties, but present coating techniques are very expensive. Additionally, known efforts to plate silver onto substrates have been imperfect because they use aqueous plating baths containing extremely toxic cyanide compounds and other compounds that contaminate the silver plating.

For example, Japanese patent JP55044540 teaches a process for the electroless plating of silver onto a substrate using an aqueous plating bath comprising silver cyanide, sodium hydroxide and potassium boron hydride as a reducing agent. This bath composition is disadvantageous because of the high toxicity of silver cyanide. Also, it is undesirable because boron hydride derivatives generate extremely flammable gaseous hydrogen and also contaminate the silver metal plating, degrading its appearance.

The present invention solves the problems of the prior art by employing a process for electroless plating of silver using a composition comprising an aqueous solution comprising a water soluble silver salt such as silver nitrate, ammonium hydroxide as a complexing agent, ammonium carbonate and/or bicarbonate as a stabilizer and hydrazine hydrate as a reducing agent. The composition of this aqueous solution is substantially free of non-volatile components that cause impure plating, allowing for improved appearance and properties of the plated silver. Further, the process generates essentially no hazardous substances and the absence of non-volatile components avoids the accumulation of byproducts that degrade the plating bath, allowing for virtually unlimited replenishment of the bath. Moreover, the unique composition of the plating bath allows metallic silver to be precipitated from the plating bath by boiling without undesirable contaminants.

This invention provides a simple low-cost method of a deposition of ultra pure silver coatings on virtually any material of any geometrical shape, including fibers and powders, by electroless autocatalytic plating. The method involves the controlled autocatalytic chemical reduction of a silver salt by a chemical reducer with the formation of a dense uniform metallic silver coating of unlimited thickness selectively on the substrate surface which is contacted with a silver plating bath.

SUMMARY OF THE INVENTION

The invention provides an electroless plating composition comprising an aqueous solution comprising:

a) a silver salt;

b) ammonium hydroxide;

c) ammonium carbonate and/or bicarbonate; and d) hydrazine hydrate.

The invention also provides a process for plating a substrate comprising:

A) providing a plating composition comprising an aqueous solution comprising:
   i) a silver salt;
   ii) ammonium hydroxide;
   iii) ammonium carbonate and/or bicarbonate; and
   iv) hydrazine hydrate; and B) contacting a substrate with the plating composition for a sufficient time and under conditions sufficient to plate metallic silver onto the substrate.

The invention further provides a process for plating a substrate comprising:

A) providing a plating composition comprising an aqueous solution comprising:
   i) a silver salt;
   ii) ammonium hydroxide;

iii) ammonium carbonate and/or bicarbonate; and
iv) hydrazine hydrate;

B) immersing a substrate into the plating composition for a sufficient time and under conditions sufficient to plate metallic silver onto the substrate; and C) removing the substrate from the plating composition.

The invention still further comprises an article comprising a substrate immersed in a composition comprising an aqueous solution comprising:

a) a silver salt;

b) ammonium hydroxide;

c) ammonium carbonate and/or bicarbonate; and d) hydrazine hydrate.

DETAILED DESCRIPTION OF THE PREFERRED EMBODIMENTS

The present invention teaches a process for uniformly plating various substrates with metallic silver using an electroless plating bath. Initially, an aqueous plating bath comprising water, a water soluble silver salt, an ammonium hydroxide complexing agent, an ammonium carbonate and/or bicarbonate stabilizer and a hydrazine reducer is formed in a suitable container.

Once all of the components are combined in a suitable container, the water soluble silver salt dissolves, releasing silver ions into the bath. The ammonium hydroxide complexing agent forms a strong complex with the silver ions and prevents chemical reduction of the silver ions in the bath while permitting selective chemical reduction on a substrate surface. The hydrazine reducer allows reduction of the silver ions to metallic silver which is deposited selectively on a substrate surface because of catalytic action of a substrate surface. In particular, after a substrate is immersed in the plating bath, the substrate surface catalyzes oxidation of the reducing agent. This oxidation causes a release of electrons that, in turn, reduce metal silver ions in the bath at the substrate surface. These reduced metal ions are then deposited onto the substrate and, over time, generate a metal shell around the substrate. The ammonium carbonate and/or bicarbonate stabilizer keeps the plating bath under operable conditions.

Chemical reduction of the silver salt by hydrazine hydrate results in the formation of only metallic silver and highly volatile gaseous byproducts which are removed from the plating bath by mere evaporation. Other bath constituents, including $N_2H_4.H_2O$, are also highly volatile and can be similarly removed through evaporation. The bath contains no substances capable of accumulating in the container and suppressing the silver plating process, and creates no hazardous substances. The plating composition is highly stable and does not require the addition of non-volatile accelerators, pH regulators or other chemical agents used to enhance plating properties. Also, because no strong complexing agents are included or generated by the bath, simple boiling of the bath is sufficient to precipitate virtually pure silver from the aqueous solution.

This process is autocatalytic, in that no catalyst separate from the aforementioned components is required to advance the silver deposition on a catalytically active surface like base and noble metals, alloys, graphite and others. Catalytically inactive materials like glass, ceramics and polymers can be activated by conventional methods, for instance by contacting with a tin salt solution and/or a noble metal solution. Additionally, the process is continuous and may be maintained for virtually an infinite time by merely replenishing each of the components of the bath.

Following formation of the plating bath, a suitable substrate is immersed in the bath for plating. The substrate remains in the plating solution for a time sufficient and under conditions sufficient to plate a substantially uniform coating of metallic silver onto the substrate. Usually the plating rate is about 0.1 to 2 microns/hour. It increases with increasing temperature and concentration of silver and hydrazine.

The bath is maintained at a temperature ranging from about 20° C. to about 98° C., more preferably from about 50° C. to about 90° C. The bath is also maintained at a preferred pH ranging from about 8 to about 13. Preferably, the bath is formed in the absence of any other additives since such would tend to accumulate in the bath. These conditions are important factors in maintaining a stable plating bath and preventing precipitation of silver from the bath.

Typically the substrate remains in the plating bath for from about 1 minute to about four hours depending on the required silver thickness preferably from about 5 minutes to about 60 minutes and most preferably from about 5 minutes to about 30 minutes. After the desired amount of metallic silver has been coated on the substrate, it is removed from the plating solution. The result is an article having a substantially uniform and virtually pure metallic silver plating, having good appearance and properties. Plating can also be done by contacting a substrate surface with a plating bath by any other technique such as spraying, pouring, brushing, etc.

In the preferred embodiment of the invention, the silver salt is water soluble. Such may include silver sulfate, silver chloride and silver nitrate, among others. Of these the most preferred silver salt is silver nitrate ($AgNO_3$). The amount of silver salt present in the bath preferably ranges from about 0.01 to about 650 g/L. More preferably, the amount of silver containing compound present ranges from about 0.1 to about 20 g/L.

The preferred complexing agent is ammonium hydroxide ($NH_4OH$). The most preferred complexing agent is a 28% solution of ammonium hydroxide. Other suitable complexing agents include organic amines, such as methylamine or ethylamine, but these are not preferred. The amount of 28% ammonium hydroxide present in the bath preferably ranges from about 1–1000 mL/L, more preferably from about 10 to about 200 mL/L.

The preferred reducer is a hydrazine compound, most preferably hydrazine hydrate ($N_2H_4.H_2O$). Other suitable hydrazines include hydrazine chloride and hydrazine sulfate, but are not preferred because of the greater probability that silver will precipitate out of the bath. The preferred amount of hydrazine hydrate present in the bath ranges from about 0.01 to about 210 g/L, more preferably from about 0.1 to about 10 g/L.

The preferred stabilizer is either ammonium carbonate ($(NH_4)_2CO_3$) and/or ammonium bicarbonate ($NH_4HCO_3$). The preferred amount of ammonium carbonate and/or bicarbonate ranges from about 0.01 to about 360 g/L, more preferably from about 10 to about 200 g/L.

Accordingly, the preferred plating bath mechanism can be described by the following general formula:

$$4\ AgNO_3+4\ NH_4OH+N_2H_4.H_2O=4\ Ag+N_2+4\ NH_4NO_3+5\ H_2O$$

The substrate may comprise any material ranging from non-metals, metals, alloys, semiconductors and non-conductors. Suitable metal substrates include stainless steel, carbon steel, nickel, iron, chromium, iron-chromium alloys, and nickel-chromium-iron alloys. Suitable non-metals include printed circuit boards, polyimide substrates, ceramic and glass substrates.

The type of container used to form the plating bath is also an important factor affecting the stability of the bath. In particular, the container should non-metallic to prevent reduction of the metal ions on the walls of the container. Additionally, means used to heat the bath should be a non-metallic heating system, and should heat the bath uniformly to prevent any reductions of metal ions in the bath.

The following non-limiting examples serve to illustrate the invention.

EXAMPLE 1

A glass microscope slide 75×25×1 mm was cleaned by polishing with an aluminum oxide suspension, treated in an ultrasonic cleaner, sensitized by an immersion for 2 minutes into 10 g/L tin chloride solution, rinsed with water, catalytically activated by an immersion for 2 min. into 1 g/L palladium chloride solution, rinsed with water and immersed for 1 hour in an electroless Ag plating bath containing 1 g/L Ag as $AgNO_3$, 200 mL/L $NH_4OH$, 70 g/L $(NH_4)_2CO_3$ and 0.35 g/L $N_2H_4.H_2O$ at 83° C. A bright mirror Ag coating of 2 micron thick was obtained. Such a silver coating is useful for glass fiber optical wave-guides and as a conductive path in electronic components.

EXAMPLE 2

Three perfluoroelastomer O-rings, Kalrez, AS-568A, K#003, DuPont Dow Elastomers, Compound 4079, 1.42×1.52 mm were etched for 10 minutes in $H_2SO_4$+$CrO_3$ mixture at 100° C., rinsed with water, rinsed with $NH_4OH$, rinsed with water, sensitized by an immersion for 2 min. into 10 g/L tin chloride solution, rinsed with water, catalytically activated by an immersion for 2 min. into 1 g/L palladium chloride solution, rinsed with water and immersed for 0.5 h in electroless Ag plating bath containing 1 g/L Ag as $AgNO_3$, 150 mL/L $NH_4OH$, 150 g/L $(NH_4)_2CO_3$ and 0.30 g/L $N_2H_4.H_2O$ at 81° C. A dense, uniform, highly adherent, electrically conductive Ag coating of 1 micron thick was obtained. This Ag coating was built-up to 13–18 micron thick by a conventional Ag electroplating. Such a silver coating is useful for corrosion protection of polymer parts in aerospace applications.

EXAMPLE 3

A silicon nitride ceramic rod, $Si_3N_4$, H25×D20 mm was cleaned in warm diluted HCL, rinsed with water, sensitized by an immersion for 2 minutes into 10 g/L tin chloride solution, rinsed with water, catalytically activated by an immersion for 2 minutes into 1 g/L palladium chloride solution, rinsed with water and immersed for 1 h in electroless Ag plating bath containing 1 g/L Ag as $AgNO_3$, 350 mL/L $NH_4OH$, 150 g/L $(NH_4)_2CO_3$ and 0.4 g/L $N_2H_4.H_2O$ at 80° C. A dense, uniform, highly adherent, electrically conductive Ag coating of 1 micron thick was obtained. This Ag coating was built-up to 10 micron thick by a conventional Ag electroplating. Such a silver coating is useful for high temperature corrosion protection of ceramic engine components, and for a primary metallization of non-conductors prior electroplating.

EXAMPLE 4

Two silicon nitride ceramic engine components, $Si_3N_4$, 65×25×12 mm were cleaned in acetone, covered by a proprietary polymer masking composition on the part of the surface, sensitized and catalytically activated as in Examples 1 to 3 and plated for 0.5 hours in an electroless Ag plating bath containing 1 g/L Ag as $AgNO_3$, 300 mL/L $NH_4OH$, 150 g/L $(NH_4)_2CO_3$ and 0.3 g/L $N_2H_4.H_2O$ at 77–90° C. A dense, uniform, highly adherent, electrically conductive Ag coating of 0.7–0.8 micron thick was obtained on an unmasked ceramic surface. The Ag coated components were heat treated at 500° C. for 0.5 hours to burnout the polymer mask and the Ag coating was selectively built-up to 10–11 micron thick by a conventional Ag electroplating. Such a silver coating is useful as high temperature corrosion protective, low-friction coating on ceramic engine components, and for a primary metallization of non-conductors prior electroplating.

EXAMPLE 5

A sample of a stainless steel shaped support 55×25×4 mm was cleaned by acetone and immersed for 45 min. in an electroless silver plating bath containing 0.8 g/L Ag as $AgNO_3$, 200 mL/L $NH_4OH$, 120 g/L $(NH_4)_2CO_3$ and 0.2 g/L $N_2H_4.H_2O$ at 60–70° C. A dense, uniform, highly adherent Ag coating of 1.2–1.4 micron thick was obtained. This silver coating reveals high catalytic activity for the decomposition of ozone in aircraft cabin air.

EXAMPLE 6

7 g of borosilicate glass microspheres of 50–70 micron particle size was degreased with acetone, catalytically activated as in EXAMPLE 5 using a porous glasss funnel and stirred for 20 min. in an electroless silver plating bath containing 0.5 g/L Ag as $AgNO_3$, 250 mL/L $NH_4OH$, 150 g/L $(NH_4)_2CO_3$ and 0.2 g/L $N_2H_4.H_2O$ at 60–650° C. A bright, uniform, continuous, highly adherent Ag coating of 0.2–0.4 micron thick was obtained. This silver coating is useful as supported catalyst, filler for electrically conductive polymers, and electrically conductive paste for electronics.

While the present invention has been particularly shown and described with reference to preferred embodiments, it will be readily appreciated by those of ordinary skill in the art that various changes and modifications may be made without departing from the spirit and scope of the invention. It is intended that the claims be to interpreted to cover the disclosed embodiment, those alternatives which have been discussed above and all equivalents thereto.

What is claimed is:

1. An electroless plating composition comprising an aqueous solution comprising:

a) a silver salt;

b) ammonium hydroxide;

c) ammonium carbonate and/or bicarbonate; and d) hydrazine hydrate.

2. The plating composition of claim 1 wherein the silver salt comprises silver nitrate.

3. The plating composition of claim 1 which comprises ammonium carbonate.

4. The plating composition of claim 1 which comprises ammonium bicarbonate.

5. The plating composition of claim 1 which comprises ammonium carbonate and ammonium bicarbonate.

6. The plating composition of claim 1 wherein the silver salt is present in an amount ranging from about 0.01 to about 650 g/L.

7. The plating composition of claim 1 wherein ammonium hydroxide is present in an amount ranging from about 1 to about 1000 mL/L.

8. The plating composition of claim 1 wherein ammonium carbonate and/or bicarbonate is present in an amount ranging from about 0.01 to about 360 g/L.

9. The plating composition of claim 1 wherein hydrazine hydrate is present in an amount ranging from about 0.01 to about 210 g/L.

10. A process for plating a substrate comprising:

A) providing a plating composition comprising an aqueous solution comprising:
i) a silver salt;
ii) ammonium hydroxide;
iii) ammonium carbonate and/or bicarbonate; and
iv) hydrazine hydrate; and B) contacting a substrate with the plating composition for a sufficient time and under conditions sufficient to plate metallic silver onto the substrate.

11. The process of claim 10 wherein the silver salt comprises silver nitrate.

12. The process of claim 10 wherein the plating composition comprises ammonium carbonate.

13. The process of claim 10 wherein the plating composition comprises ammonium bicarbonate.

14. The process of claim 10 wherein the plating composition comprises ammonium carbonate and ammonium bicarbonate.

15. The process of claim 10 wherein the plating composition is autocatalytic.

16. The process of claim 11 wherein the substrate is uniformly plated with metallic silver.

17. The process of claim 10 wherein the temperature of the plating composition ranges from about 20° C. to about 98° C.

18. The process of claim 10 wherein the silver nitrate is present in the plating composition in an amount ranging from about 0.01 to about 650 g/L.

19. The process of claim 10 wherein ammonium hydroxide is present in the plating composition in an amount ranging from about 1 to about 1000 mL/L.

20. The process of claim 10 wherein ammonium carbonate and/or bicarbonate is present in the plating composition in an amount ranging from about 0.01 to about 360 g/L.

21. The process of claim 10 wherein hydrazine hydrate is present in the plating composition in an amount ranging from about 0.01 to about 210 g/L.

22. The process of claim 10 which is conducted without electrolysis.

23. The process of claim 10 wherein the substrate comprises a metal.

24. The process of claim 10 wherein the substrate comprises a non-metal.

25. The process of claim 10 wherein the substrate comprises a semiconductor.

26. The process of claim 10 wherein the substrate comprises a ceramic.

27. A process for plating a substrate comprising:

A) providing a plating composition comprising an aqueous solution comprising:
i) a silver salt;
ii) ammonium hydroxide;
iii) ammonium carbonate and/or bicarbonate; and
iv) hydrazine hydrate;

B) immersing a substrate into the plating composition for a sufficient time and under conditions sufficient to plate metallic silver onto the substrate; and C) removing the substrate from the plating composition.

28. An article comprising a substrate immersed in a composition comprising an aqueous solution comprising:

a) a silver salt;
b) ammonium hydroxide;
c) ammonium carbonate and/or bicarbonate; and
d) hydrazine hydrate.

* * * * *